United States Patent [19]

Nausedas

[11] 3,963,117

[45] June 15, 1976

[54] ARTICLE BRAKE FOR INCLINED CONVEYOR

[75] Inventor: Joseph A. Nausedas, Chicago, Ill.

[73] Assignee: Union Carbide Corporation, New York, N.Y.

[22] Filed: Apr. 11, 1973

[21] Appl. No.: 350,297

[52] U.S. Cl. ..... 198/227; 99/407; 134/125

[51] Int. Cl.[2] ..... B65G 47/00

[58] Field of Search ..... 198/227, 160; 99/407; 134/125, 126; 271/220, 198, 47; 280/493

[56] References Cited

UNITED STATES PATENTS

| | | | |
|---|---|---|---|
| 228,035 | 5/1880 | Chappell | 198/160 |
| 1,313,418 | 8/1919 | Reed | 198/160 |
| 1,361,294 | 12/1920 | Tschache | 198/160 |
| 3,464,735 | 9/1969 | Smith | 280/493 UX |

*Primary Examiner*—Evon C. Blunk
*Assistant Examiner*—Douglas D. Watts
*Attorney, Agent, or Firm*—Maurice W. Ryan

[57] ABSTRACT

Articles being transported upwardly on an inclined conveyor are restrained against rolling back down the conveyor by a brake comprising an array of parallel spaced apart rods extending longitudinally in the direction of conveyor movement, pivotally suspended at one end and disposed to impose weight on each article, holding it against the moving conveyor to insure progression in the desired direction only.

3 Claims, 4 Drawing Figures

Figure 1:
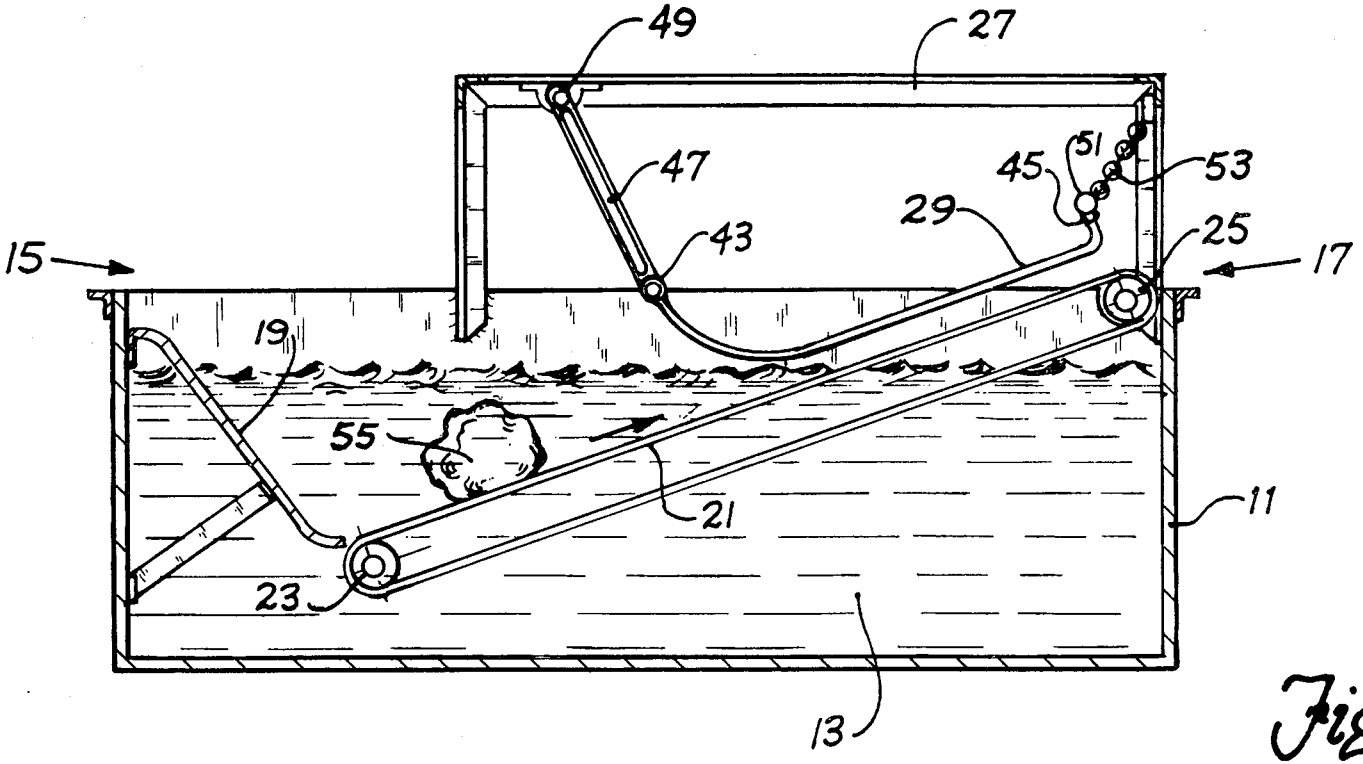

11
13
15
17
19
21
23
25
27
29
43
45
47
49
51
53
55
55a

ARTICLE BRAKE FOR INCLINED CONVEYOR

This invention relates to an article roll back brake for an inclined conveyor, particularly to a brake for restraining against the rolling back down of articles being transported upwardly on a substantially smooth surfaced inclined conveyor, and more particularly to an anti-roll back brake to insure positive progression of food products, such as meat articles, in process packaging and handling.

For convenience the invention will be described with reference to its applicability in meat packaging processes. It is to be understood however that the invention is not in any way limited solely to such application.

Food packaging processes generally and the packaging of meat articles in particular benefit in many ways from the automation of processes steps which would otherwise be performed manually. Not only does automation to whatever extent practicable increase speed and production efficiency, but human contact and the possibility of consequent contamination are considerably lessened. Meat packers are presently able to package portioned fresh meat cuts in flexible plastic film bags which are tightened about the article, clip sealed closed, and heat shrunk to form unitary sealed package articles which can be readily and easily handled for further processing, storing, or transporting. A known technique in such processing involves immersing each bagged meat article in a heated water bath, known as a shrink tank or shrink tunnel, which rapidly shrinks the plastic film bag tightly about the article. It is important in packaging fresh meat with this technique that the article be removed from the shrink tank as promptly as possible before the meat itself is cooked or discolored in the elevated temperature of the water bath. Towards this end, an inclined conveyor is used to move each heat shrunk packaged article up and out of the shrink tank hot water bath as soon as the bag is shrunk about the meat cut. The inclined conveyor works well as long as a packaged and heat shrunk meat article has some degree of flat surface contact with the moving conveyor surface. The packaged meat articles however generally have a shape approximating a prolate spheroid and thus tend to roll backward down the conveyor against the direction of desired movement, jamming against the following article in process which might assist it up the conveyor and remaining, sometimes together with other jammed up articles, too long in the hot water bath resulting in one or more articles being well cooked and ruined. Projections from the conveyor surface such as conveyor flight bars are not practical to counteract this roll back tendency, since they require increased tank sizes to provide necessary clearances from the tank walls and from article entry and exit chutes. Furthermore any sort of article grabbing protrusion from the conveyor surface would tend to pierce the plastic film bag and the meat itself and destroy the physical and hygienic integrity of the article. Several techniques and devices other than conveyor surface projections have been tried in attempts to solve this roll back problem but, prior to the time of the present invention, no completely satisfactory solution has been found.

With this then as the state of the art, the present invention was conceived and developed to provide an article brake for restraining articles moving upwardly on an inclined conveyor against rolling back down the conveyor.

The invention also provides an article anti rollback device or brake for an inclined conveyor which is consistently reliable in handling articles over a wide range of sizes and of widely varying physical shapes within the limits of the conveyor itself.

Another and important feature of the invention is the provision of an anti rollback brake which is simple in operation and can be readily installed to operate in conjunction with practically any inclined conveyor having sufficient available overhead space.

A still further and significant advance is provided by the invention in that it makes available to the meat packing industry a device which keeps meat articles in process on an inclined conveyor without detrimentally affecting the products or in any way impairing their physical and hygienic integrity.

Figure 2:
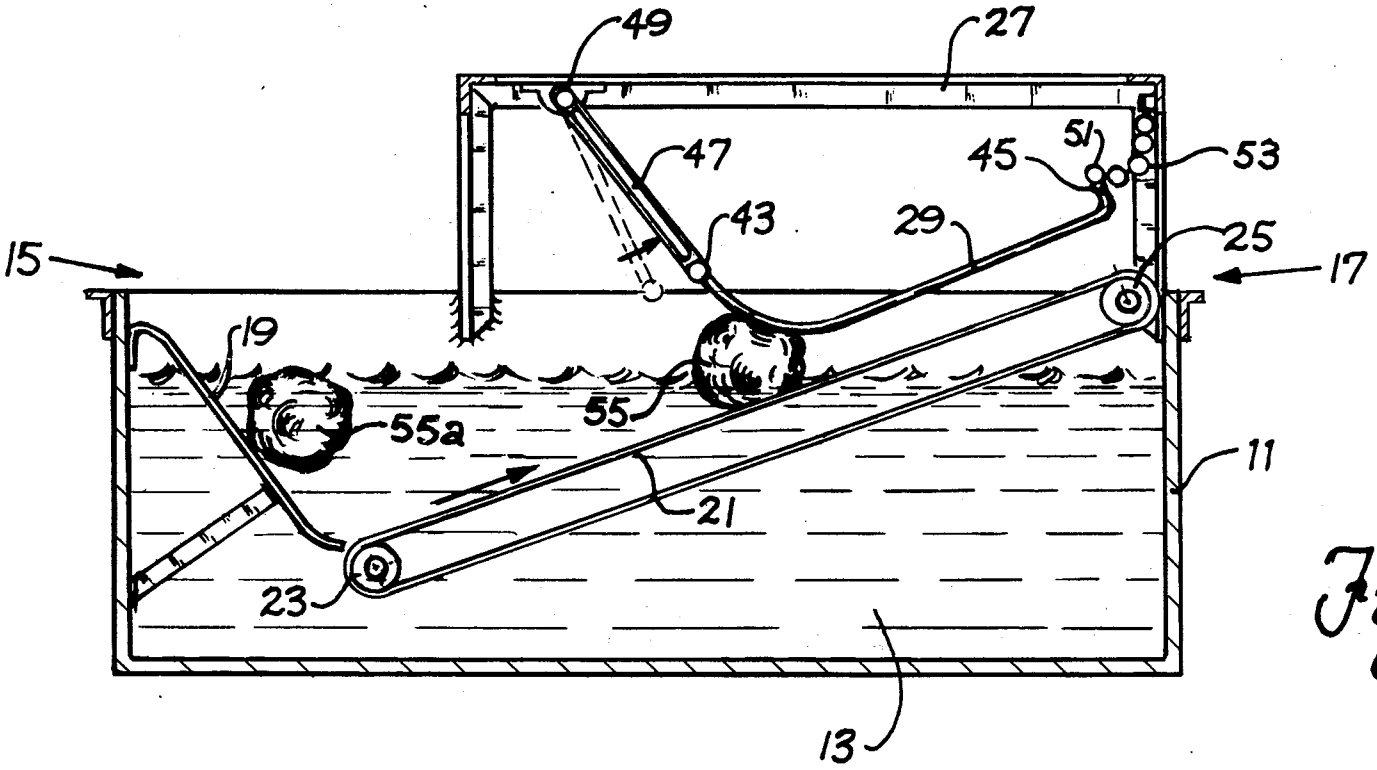
Figure 3:
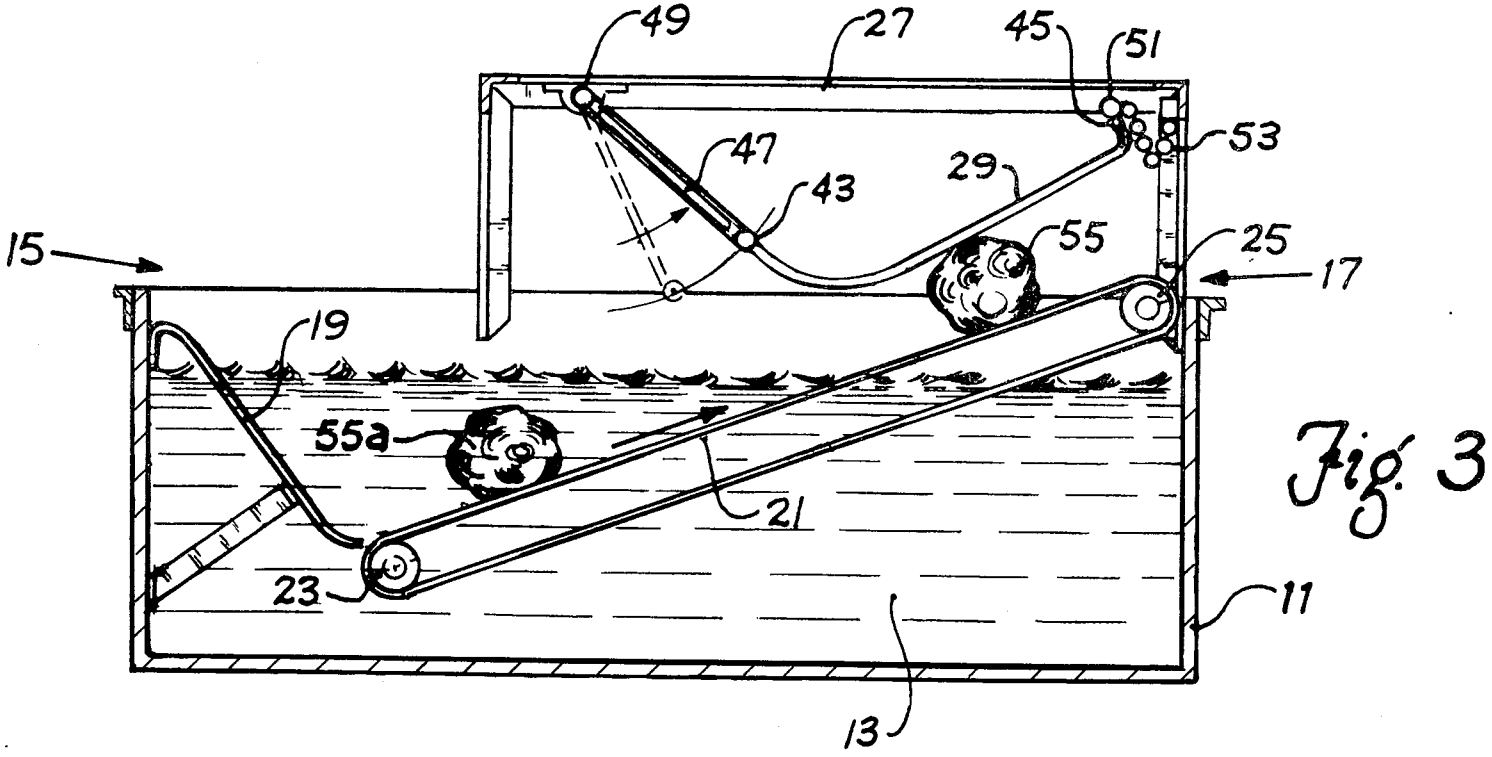
Figure 4:
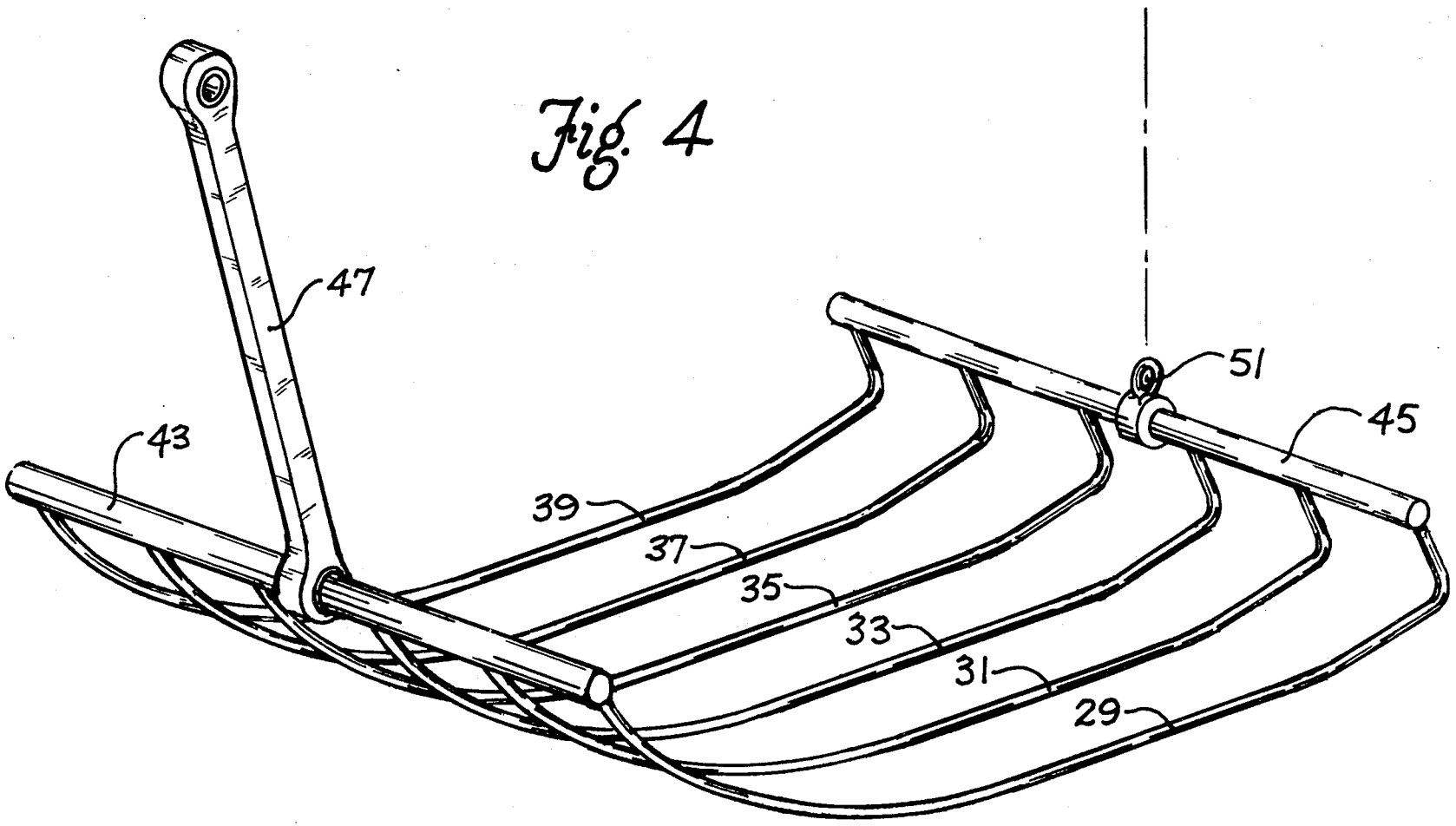

These and other features, advantages, and objects of the present invention will be the more readily understood and appreciated from the ensuing description and from the appended drawings wherein:

FIGS. 1, 2 and 3 are sectional elevations of a shrink tank provided with brake apparatus according to the present invention and illustrating an operational sequence, and FIG. 4 is a perspective view showing a typical brake assembly according to the present invention.

In general, apparatus according to the present invention comprehends an article roll back brake for an inclined conveyor comprising, in combination, an array of elongate parallel spaced apart downwardly convexed longitudinal elements disposed longitudinally in the direction of movement of the inclined conveyor, a brake frame arranged and disposed to support said array at a preselected distance above the inclined conveyor, means connecting one end of said array pivotally to said frame, and stop means disposed to arrest the downward pivotal movement of the other end of said array at a preselected point out of impingement on the conveyor.

With reference to the drawings, FIGS. 1, 2, 3 show a shrink tank 11, holding a hot water bath 13 and having an article input end 15 and an article exit end 17. A chute 19 is fitted adjacent input end 15 of the tank 11 and is arranged to direct packaged meat articles to be heat shrunk to the lower depths of the bath. An inclined conveyor comprising an endless belt 21 on conveyor rollers 23 and 25 extends as shown from the lowermost end of the chute 19 upwardly to the tank exit end 17. The conveyor is driven in the direction shown by the arrows by motive means which are conventional and not part of this invention.

A brake frame 27 is mounted on the tank 11 above the conveyor. FIG. 4 shows a typical embodiment of a brake element which may comprise an array of elongate parallel spaced apart downwardly convexed longitudinal elements 29, 31, 33, 35, 37, 39, held at their respective ends in a preselected spaced relationship by cross bar elements 43, 45 to which they are fixedly attached. In the illustrated embodiment the longitudinal elements are rods, of stainless steel for instance, as are the cross bar elements. A pivot arm 47 is pivotally attached to cross bar element 43 at its midpoint and extends from the cross bar to pivot means 49 on the frame 27. Cross bar element 45 is provided with an eye bolt or ring 51 at its midpoint.

The brake element shown in FIG. 4 is mounted on the brake frame 27 as shown in FIGS. 1, 2, 3, with the pivot arm 47 connected to the frame by pivot means 49 and the ring 51 connected to the frame by a flexible leash means such as a chain 53. In this arrangement the downward convexities of the longitudinal elements face toward and are spaced above the upper or carrying surface of the conveyor belt 21 with relatively straight portions of the longitudinal elements disposed substantially parallel to the conveyor surface.

In FIG. 1 of the drawings a bagged and sealed meat package article 55 is shown in the process of being heat shrunk. Article 55 in FIG. 1 has entered the shrink tank 11 at input end 15, slid or rolled down input chute 19, and is being conveyed upwardly towards the tank exit end 17. FIG. 2 shows the article 55 carried up on the conveyor to a preselected point where it engages the convexities of some or all, depending on its size, of the rod longitudinal elements 29 through 39 and initiates an upward pivotal swing of the brake assembly. As the travel of article 55 progresses to the point shown in FIG. 3, the brake assembly has been raised to its maximum upward swing for this article and has moved pivotally back downward a bit so that the rod element 29-39 convexities are in a roll back stopping position and the straight portions of some or all of the rod elements bear on the article, weight loading it into firm positive contact with the moving conveyor surfaces, insuring its continued progression up the conveyor to the tank exit end 17 where it falls onto a removal chute or conveyor not shown. FIG. 3 also shows another article 55a in progress up the conveyor following article 55. From foregoing description it can be appreciated that an article brake apparatus according to present invention provides a sufficiently heavy downwardly directed force which insures good effective article contact with the moving conveyor surface while at the same time is free moving about the pivoted suspension point to accommodate various sized articles within a given article size range.

The length of the chain 53 is adjustable and in practice it has been found advantageous to set this chain length so that the straight portions of the elongate elements of the brake assembly rest substantially parallel to the conveyor surface with no article under the brake. The gap or distance between the conveyor surface and the brake rod element straight sections is of course adjustable by varying the relative height of the pivot point on the brake frame 27.

Any conventionally available materials may be used to fabricate apparatus according to the invention. In the described and illustrated embodiment the brake frame is fabricated from structural angle iron or the like and the brake assembly shown in FIG. 4 is made of ¼ in. and ½ in. stainless steel rod stock.

The use of multiple parallel spaced rods in the brake assembly premits the effective handling of a wide range of article sizes, a particular article in progress coming under two, three, or more elongate elements as it moves up the conveyor.

Alternative embodiments of the invention, but within its scope and spirit, will, in the light of the foregoing disclosure, occur to persons familiar with the art. It is intended therefore that the description herein be taken as illustrative only and not in any limiting sense.

What is claimed is:

1. An article roll back brake for an inclined conveyor comprising, in combination, an array of elongate parallel spaced apart downwardly convexed longitudinal elements disposed longitudinally in the direction of movement of the inclined conveyor, a brake frame arranged and disposed to support said array at a preselected distance above the inclined conveyor, a pivot arm having one end pivotally connected to said brake frame and another end pivotally connected to said array, and stop means disposed to arrest the downward pivotal movement of the other end of said array at a preselected point out of impingement on the conveyor, whereby dual pivotal movement of said array occurs at the end of said array opposite the end at which said stop means is disposed.

2. Apparatus according to claim 1 wherein the downwardly convexed longitudinal elements each include a straight linear portion disposed substantially parallel to the inclined conveyor surface when the downward pivotal movement of said array is arrested by said stop means.

3. Apparatus according to claim 1 wherein the longitudinal elements are round cross section rods.

* * * * *